US009387697B2

(12) United States Patent
Toya

(10) Patent No.: US 9,387,697 B2
(45) Date of Patent: Jul. 12, 2016

(54) LIQUID DISCHARGE APPARATUS WITH HEATED AND NON-HEATED AREAS

(71) Applicant: SEIKO EPSON CORPORATION, Tokyo (JP)

(72) Inventor: Akihiro Toya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/165,275

(22) Filed: Jan. 27, 2014

(65) Prior Publication Data

US 2014/0240417 A1 Aug. 28, 2014

(30) Foreign Application Priority Data

Feb. 27, 2013 (JP) ..... 2013-036781

(51) Int. Cl.
*B41J 11/00* (2006.01)
*B41J 15/04* (2006.01)

(52) U.S. Cl.
CPC ..... *B41J 11/002* (2013.01); *B41J 15/04* (2013.01)

(58) Field of Classification Search
None
See application file for complete search history.

(56) References Cited

U.S. PATENT DOCUMENTS

| | | | | |
|---|---|---|---|---|
| 6,027,003 | A | 2/2000 | Gassner | |
| 6,309,046 | B1 * | 10/2001 | Izawa et al. | 347/40 |
| 2007/0172285 | A1 * | 7/2007 | Izawa et al. | 400/188 |
| 2007/0222805 | A1 * | 9/2007 | Moscato et al. | 347/12 |
| 2011/0063389 | A1 * | 3/2011 | Hanson et al. | 347/102 |
| 2011/0228025 | A1 | 9/2011 | Miyamoto et al. | |
| 2011/0242244 | A1 | 10/2011 | Ohba et al. | |
| 2013/0215202 | A1 * | 8/2013 | Koller et al. | 347/102 |
| 2014/0176640 | A1 * | 6/2014 | Hawryschuk et al. | 347/25 |

FOREIGN PATENT DOCUMENTS

| | | |
|---|---|---|
| JP | 05-338126 | 12/1993 |
| JP | 2005-199434 | 7/2005 |
| JP | 2007-196513 | 8/2007 |
| JP | 2009-196804 | 3/2009 |
| JP | 2011-194570 | 10/2011 |

* cited by examiner

*Primary Examiner* — Bradley Thies
(74) *Attorney, Agent, or Firm* — Workman Nydegger

(57) ABSTRACT

A liquid discharge apparatus includes a support that supports a medium; a head that discharges liquid to the medium transported onto the support; and a drying portion that dries the liquid that has landed on the medium. The liquid discharge apparatus has a heated area and a non-heated area. The drying portion is disposed in the heated area, and the support and the head are disposed in the non-heated area.

7 Claims, 2 Drawing Sheets

LIQUID DISCHARGE APPARATUS WITH HEATED AND NON-HEATED AREAS

BACKGROUND

1. Technical Field

The present invention relates to a liquid discharge apparatus.

2. Related Art

Ink jet printers that form an image by discharging ink to a medium are in practical use. In recent years, a so-called line ink jet printer has been developed, in which a head is substantially fixed to the printer. Such a line ink jet printer is capable of high-speed printing, but has the problem of how to dry ink.

JP-A-2005-199434 discloses a method for preventing condensation in a printer having a heater in the vicinity of an ink jet head.

A conceivable method for drying ink is using heat. However, the use of heat may cause a head that discharges ink to be also heated. Heating the head accelerates hardening of the ink in the head, thus posing problems, such as nozzle clogging. This requires a liquid discharge apparatus in which impairment on the reliability of the head is reduced while still accelerating the drying of liquid discharged to a medium.

SUMMARY

An advantage of some aspects of the invention is to provide a liquid discharge apparatus in which the reliability of a head is not or insubstantially impaired while still accelerating drying of liquid discharged to a medium.

A liquid discharge apparatus according to an aspect of the invention includes a support that supports a medium; at least one head that discharges liquid to the medium transported onto the support; and a drying portion that dries the liquid that has landed on the medium. The liquid discharge apparatus has a heated area and a non-heated area. The drying portion is disposed in the heated area, and the support and the head are disposed in the non-heated area.

Other features of the invention will be apparent from the following description of this specification and the accompanying drawings.

BRIEF DESCRIPTION OF DRAWINGS

The invention will be described with reference to the accompanying drawings, wherein like numbers reference like elements.

DESCRIPTION OF EXEMPLARY EMBODIMENTS

Figure 1:
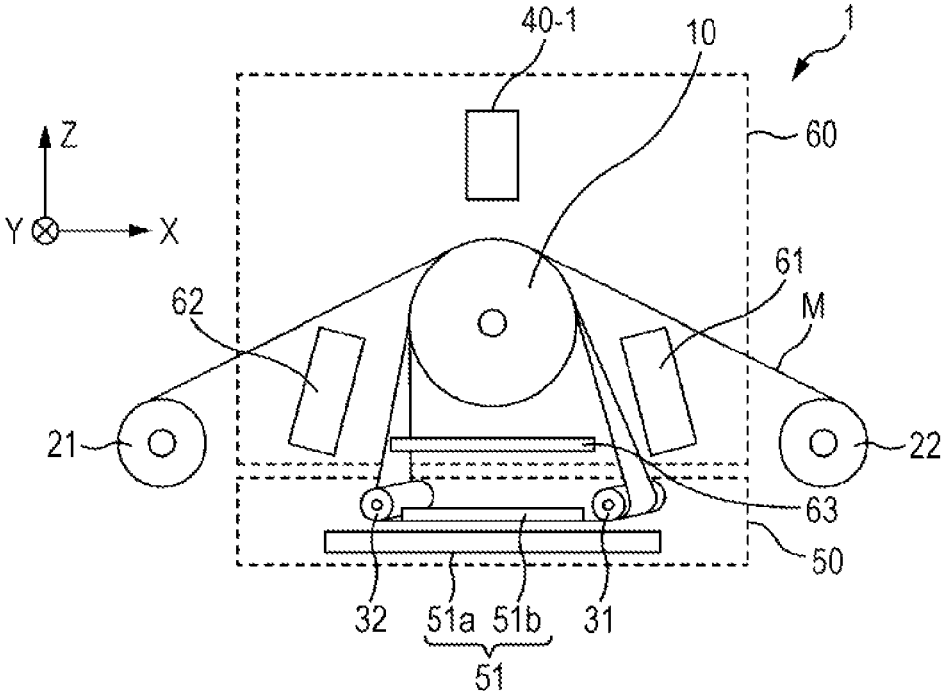
FIG. 1 is a schematic side view of an ink jet printer according to an embodiment of the invention.

With descriptions of this specification and the accompanying drawings, at least the following are apparent. That is, according to the embodiments, there is provided a liquid discharge apparatus including a support that supports a medium; at least one head that discharges liquid to the medium transported onto the support; and a drying portion that dries the liquid that has landed on the medium. The liquid discharge apparatus has a heated area and a non-heated area.

The drying portion is disposed in the heated area, and the support and the head are disposed in the non-heated area.

In this configuration, the drying portion is disposed in the heated area, and the support and the head are disposed in the non-heated area. This reduces a tendency to transmit heat from the drying portion to the support and the head. This therefore reduces a tendency to heat the support and the head near the support while still accelerating drying of liquid discharged to the medium. Thus, a liquid discharge apparatus in which clogging (and so forth) of the nozzles of the head can be suppressed, and thus the reliability of the head is not or insubstantially impaired.

Preferably, in the liquid discharge apparatus, the support includes a first roller that transports the medium wound around the outer circumferential surface thereof. The head is disposed at a position facing the outer circumferential surface of the first roller. The liquid discharge apparatus includes at least one second roller that winds the medium (to which the liquid is discharged) therearound upstream of the drying portion in a transporting path of the medium. The liquid discharge apparatus also includes at least one third roller that winds the medium (to which the liquid is discharged) therearound downstream of the drying portion in the transporting path of the medium. Furthermore, at least the third roller is disposed in the heated area.

In this configuration, the third roller is disposed in the heated area. This allows the path of the medium to be changed in the heated area after the medium exits the drying portion. The medium whose path is changed can then enter the non-heated area. This configuration allows the heated area and the non-heated area to be appropriately separated from each other.

Preferably, the liquid discharge apparatus further includes a thermal insulator at least between the third roller and the first roller.

This allows the heated area and the non-heated area to be separated by the thermal insulator. This can suppress the amount of heat in the heated area that is transmitted to the non-heated area.

Preferably, the liquid discharge apparatus includes at least one cooling portion that cools the medium transported at least between the third roller and the first roller.

This can reduce transmission of the heat from the heated area, in which the third roller is provided, to the non-heated area by cooling the medium between the third roller and the first roller.

Preferably, the second roller, the third roller, the head, and the cooling portion include a plurality of second rollers, third rollers, heads, and cooling portions, respectively; and a plurality of kinds of liquid are discharged to the medium.

This allows the medium to pass through the heated area and the non-heated area a plurality of times. Also in this configuration, the heated area and the non-heated area are appropriately separated from each other. Thus, a liquid discharge apparatus can be provided in which clogging of the nozzles of the head (and so forth) are suppressed, and thus the reliability of the head is not or is insubstantially impaired.

Preferably, the axes of the plurality of second rollers and the plurality of third rollers are angularly offset with respect to the axis of the first roller, so that the medium is wound a plurality of times in the axial direction of the first roller.

This allows the medium to pass through the heated area and the non-heated area a plurality of times.

Preferably, the drying portion is disposed at a position facing the head, with the support disposed therebetween.

This allows the drying portion that generates heat to be spaced apart from the head.

Preferably, the medium is fed out of a feed roll (around which the medium before the liquid is discharged is wound) and is taken up by a take-up roll after the liquid is discharged.

This allows the medium to be continuously fed from the feed roll and to be continuously recovered by the take-up roll.

Embodiment

Figure 2:
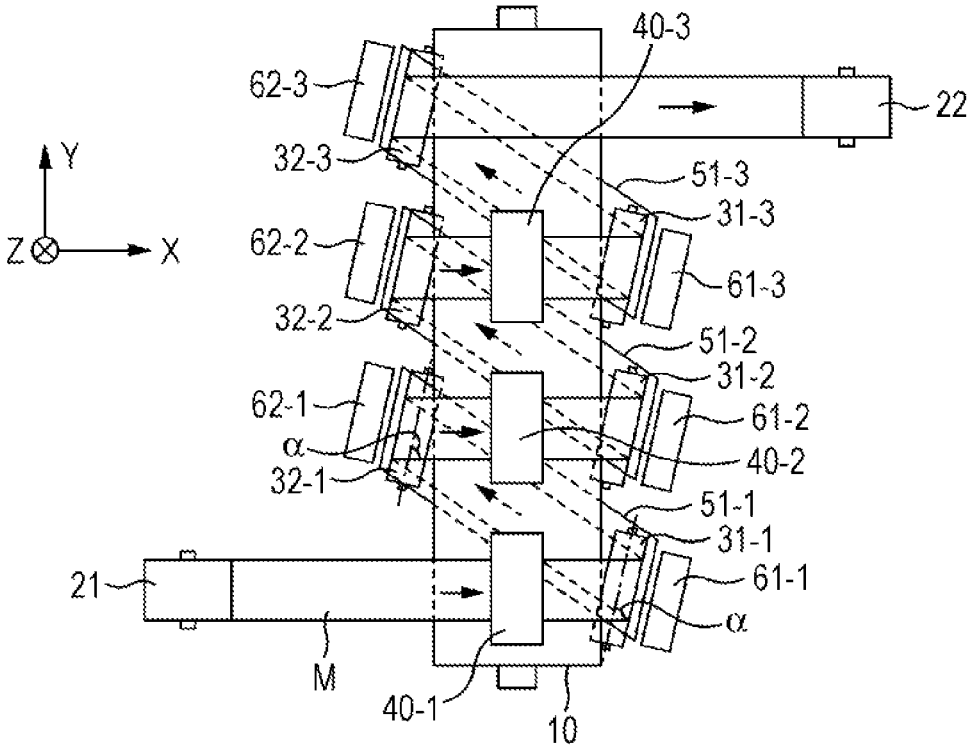
FIG. 2 is a schematic plan view of the ink jet printer of this embodiment.

FIG. 1 is a schematic side view of an ink jet printer 1 according to an embodiment of the invention. FIG. 2 is a schematic plan view of the ink jet printer 1 of this embodiment. The configuration of the ink jet printer 1 of this embodiment will be described below with reference to the drawings. FIG. 1 and FIG. 2 show an X-axis, a Y-axis, and a Z-axis for the convenience of explanation. The Z-axis direction indicates the vertical direction of the ink jet printer 1, and the X-axis and the Y-axis indicate the perpendicular horizontal directions.

The ink jet printer 1 (corresponding to a liquid discharge apparatus) includes a rotating drum 10 (corresponding to a support and a first roller), a feed roll 21, and a take-up roll 22. The ink jet printer 1 further includes a plurality of inlet rollers 31 (corresponding to a second roller), and a plurality of outlet rollers 32 (corresponding to a third roller). The ink jet printer 1 further includes a plurality of drying units 51 (corresponding to a drying portion), a plurality of first cooling units 61, a plurality of second cooling units 62 (corresponding to a cooling portion), and a plurality of thermal insulators 63.

The rotating drum 10 in the ink jet printer 1 of this embodiment transports a medium M wound around the outer circumferential surface thereof with the rotation thereof. The rotating drum 10 is a rotating drum whose axial center is aligned with the Y-axis direction and which extends in the Y-axis direction.

The feed roll 21 feeds paper, an example of the medium M, to the rotating drum 10. The take-up roll 22 recovers the paper subjected to printing.

The ink jet printer 1 of this embodiment can discharge three kinds of ink. Thus, the ink jet printer 1 includes three printing units. The printing units each include an inlet roller 31, an outlet roller 32, a head 40, a drying unit 51, a first cooling unit 61, a second cooling unit 62, and a thermal insulator 63.

In FIG. 2, components of a first printing unit are given suffix number "1" after a hyphen "-", components of a second printing unit are given suffix number "2" after a hyphen "-", and components of a third printing unit are given suffix number "3" after a hyphen "-". For common components, hyphen "-" and the following number are not given for explanation.

The heads 40 are disposed above the rotating drum 10 and on the path of the medium M, to be described later. The heads 40 may be disposed at any other positions facing the outer circumferential surface of the rotating drum 10 and allowing ink to be discharged onto the medium M.

The inlet rollers 31 are disposed below the rotating drum 10 and in the positive direction of the X-axis direction. The inlet rollers 31 play the role of winding the medium M, to which ink is discharged, therearound upstream of the respective drying units 51, to be described later, in the transporting path of the medium M and changing the path thereof. The outlet rollers 32 are disposed below the rotating drum 10 and in the negative direction of the X-axis direction. The outlet rollers 32 play the role of winding the medium M therearound downstream of the respective drying units 51 in the transporting path of the medium M and changing the path thereof.

The axial centers of the inlet rollers 31 and the axial centers of the outlet rollers 32 are not aligned with the axial center of the rotating drum 10 and have a predetermined angle $\alpha$ with respect to the X-axis (FIG. 2). The outlet rollers 32 are offset from the inlet rollers 31 in the positive direction of the Y-axis direction. The drying units 51 are disposed below the rotating drum 10 and between the inlet rollers 31 and the outlet rollers 32. The drying units 51 dry ink on the medium M that is moving between the inlet rollers 31 and the outlet rollers 32.

The thermal insulators 63 are disposed between the rotating drum 10 and the drying units 51. The first cooling units 61 are disposed lower than the central axis of the rotating drum 10 and higher than the inlet rollers 31 and in the positive direction of the X-axis direction with respect to the rotating drum 10. The first cooling units 61 cool the medium M moving between the rotating drum 10 and the inlet rollers 31.

The second cooling units 62 are disposed lower than the central axis of the rotating drum 10 and higher than the outlet rollers 32 and in the negative direction of the X-axis with respect to the rotating drum 10. The second cooling units 62 cool the medium M moving between the rotating drum 10 and the outlet rollers 32.

As shown in FIG. 2, the printing units are disposed at an angle with respect to the X-axis. The plurality of (in this case, three) printing units are arranged side by side in the Y-axis direction.

In the thus-configured ink jet printer 1, the medium M fed from the feed roll 21 is first wound on the top of the rotating drum 10 below a head 40-1. Ink ejected from the head 40-1 is discharged onto the medium M. The medium M is thereafter wound around an inlet roller 31-1. Since the inlet roller 31-1 has the predetermined angle $\alpha$, as described above, the moving direction of the medium M moving in the X-axis direction is changed, as shown in FIG. 2.

The medium M thereafter passes through a drying unit 51-1. Thus, the ink that has landed on the medium M is dried. Next, the medium M is wound around an outlet roller 32-1. The outlet roller 32-1 also has the predetermined angle $\alpha$, as described above, and the moving direction of the wound medium M is changed so as to be aligned with the X-axis direction.

The medium M is thereafter subjected to printing by the second printing unit and the third printing unit by the process of transportation substantially the same as above. Since this embodiment has three printing units, printing with three kinds of ink is performed, and after completion of the printing, the medium M is taken up by the take-up roll 22.

During the transportation of the medium M, the medium M, which is wound around the rotating drum 10, can be transported without slipping over the outer circumference of the rotating drum 10. In other words, the circumferential speed of the rotating drum 10 is substantially the same as the transporting speed of the medium M.

Figure 3:
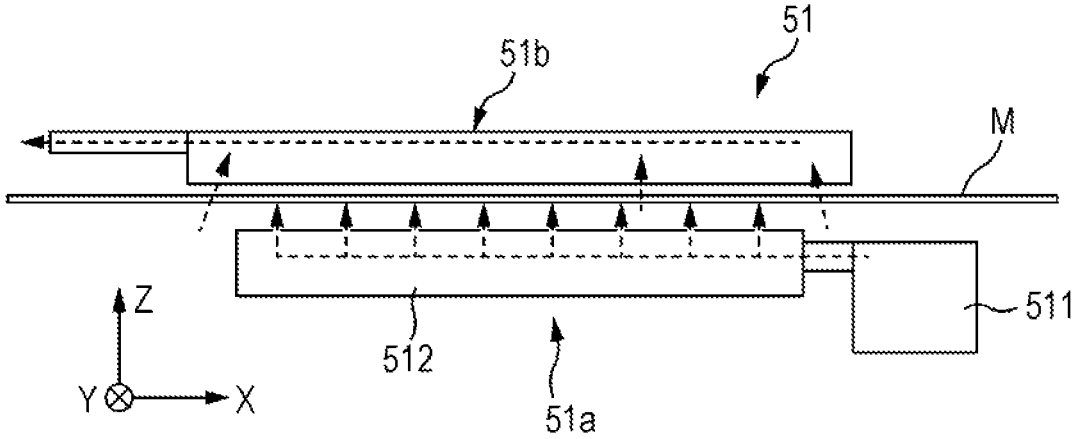
FIG. 3 is an explanatory diagram of a drying unit.

FIG. 3 is an explanatory diagram of the drying units 51. The drying units 51 each include a hot-air blowing portion 51*a* and a hot-air recovery portion 51*b*. The hot-air blowing portion 51*a* includes a hot-air blasting portion 511 and a nozzle box 512. Broken arrows in FIG. 3 indicate the paths of hot air.

The hot-air blowing portion 51*a* accelerates drying of the ink that has landed on the medium M by blowing hot air against the medium M. The hot-air blowing portion 51*a* generates hot air with the hot-air blasting portion 511 having a heat source and a blower. The hot-air blowing portion 51 is connected to the nozzle box 512. The nozzle box 512 has a plurality of holes (nozzles) directed to the medium M and has a structure in which hot air is blown through the nozzles.

The hot-air recovery portion 51*b* includes an air exhauster. The hot-air recovery portion 51*b* recovers air around the hot-air blowing portion 51*a* and exhausts the air to the outside of the ink jet printer 1. This allows the heat discharged by the hot-air blowing portion 51*a* to be exhausted. This allows the heat to be substantially kept only in the heated area 50 in which the drying units 51 are disposed, thereby preventing the heat from being exerted on the non-heated area 60.

Figure 4:
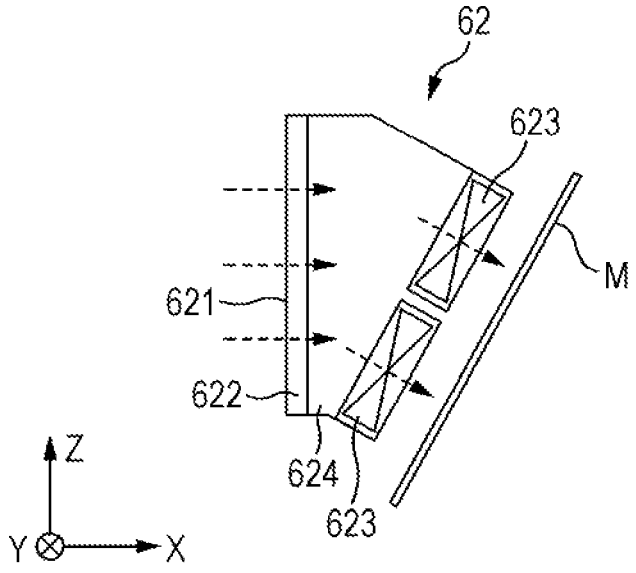
FIG. 4 is an explanatory diagram of a cooling unit.

FIG. 4 is an explanatory diagram of the second cooling units 62. Since the first cooling units 61 mentioned above have the same configuration as that of the second cooling units 62, the second cooling units 62 will be described here as an example. The second cooling units 62 each include a duct 624 accommodating a filter 622 and a plurality of cooling fans 623. Arrows indicated by broken lines in FIG. 4 indicate the path of air.

An outside-air inlet 621 at one end of the duct 624 is fitted with the filter 622. The cooling fans 623 are provided at the other end of the duct 624. The cooling fans 623 are attached in a direction in which air can be blown to the medium M. This allows air taken through the outside-air inlet 621 to be blown against the medium M. This decreases the temperature of the medium M previously heated by the drying units 51, described above.

In the thus-configured ink jet printer 1, the heated area 50 and the non-heated area 51 are divided by the placement of the components. Specifically, the heated area 50 has the inlet rollers 31, the outlet rollers 32, and the drying units 51. On the other hand, the non-heated area 60 has the rotating drum 10, the heads 40, the first cooling units 61, the second cooling units 62, and the thermal insulators 63.

In this configuration, the drying units 51 are disposed in the heated area 50, and the rotating drum 10 and the heads 40 are disposed in the non-heated area 60. This reduces a tendency to transmit the heat from the drying units 51 to the rotating drum 10 and the heads 40. This therefore reduces a tendency to heat the rotating drum 10 and the heads 40 near the rotating drum 10 while still accelerating drying of ink discharged to the medium M with the drying units 51. Thus, the ink jet printer 1 in which clogging (and so forth) of the nozzles of the heads 40 can be suppressed, and thus the reliability of the heads 40 is not or is insubstantially impaired. The appropriate separation of the heated area 50 and the non-heated area 60 also offers the advantage of suppressing condensation on the heads 40.

In the ink jet printer 1, the outlet rollers 32 are disposed in the heated area 50. This allows the path of the medium M to be changed in the heated area 50 after the medium M exits the drying units 51. The medium M whose path is changed can then enter the non-heated area 60. This configuration allows the heated area 50 and the non-heated area 60 to be appropriately separated from each other.

The ink jet printer 1 has the thermal insulators 63 at least between the outlet rollers 32 and the rotating drum 10. This can suppress the heat in the heated area 50 to be transmitted to the non-heated area 60.

The ink jet printer 1 has the second cooling units 62 that cool the medium M transported between the outlet rollers 32 and the rotating drum 10. This can reduce transmission of the heat in the heated area 50, in which the outlet rollers 32 are provided, to the non-heated area 60 by cooling the medium M between the outlet rollers 32 and the rotating drum 10.

The ink jet printer 1 has a plurality of sets of the inlet roller 31, the outlet roller 32, the head 40, and the second cooling unit 62 and is configured to discharge a plurality of kinds of ink onto the medium M. This allows the medium M to pass through the heated area 50 and the non-heated area 60 a plurality of times. Also in this configuration, the heated area 50 and the non-heated area 60 are appropriately separated from each other. Thus, the ink jet printer 1 in which clogging of the nozzles of the heads 40 and so on are suppressed, and thus the reliability of the heads 40 is hardly impaired can be provided.

The ink jet printer 1 has a configuration in which the plurality of inlet rollers 31 and the plurality of outlet rollers 32 are disposed such that the axes are angularly offset with respect to the rotating drum 10, so that the medium M can be wound a plurality of times in the axial direction of the rotating drum 10. This allows the medium M to pass through the heated area 50 and the non-heated area 60 a plurality of times.

In the ink jet printer 1, the drying units 51 are disposed at positions facing the heads 40, with the rotating drum 10 disposed therebetween. This allows the drying units 51 that generate heat to be spaced apart from the heads 40.

In the ink jet printer 1, it is preferable that the medium M be taken out from the feed roll 21 (around which the medium M before ink is discharged thereto is wound) and be taken up by the take-up roll 22 after ink is discharged. This allows the medium M to be continuously fed from the feed roll 21, thus allowing continuous printing.

Other Embodiments

The above embodiment takes the ink jet printer 1 as an example of the liquid discharge apparatus. Alternatively, a liquid discharge apparatus that ejects or discharges fluid other than ink (liquid, liquid in which functional particles are dispersed, or fluid such as gel) may be embodied. The same technique as that of the above embodiment may be applied to various apparatuses based on an ink ejecting technique, such as a color-filter manufacturing apparatus, a dyeing apparatus, a micromachining apparatus, a semiconductor manufacturing apparatus, a surface treatment apparatus, a three-dimensional forming apparatus, a vaporizer, an organic electroluminescence (EL) manufacturing apparatus (in particular, a high-molecular EL manufacturing apparatus), a display manufacturing apparatus, a film growing apparatus, and a DNA-chip manufacturing apparatus. Methods and manufacturing methods for the same are also within the range of application.

Head

In the above embodiment, a piezoelectric device can be used to discharge ink. However, a method for discharging liquid is not limited thereto. Other methods may be used, such as a method of generating bubbles in the nozzles using heat.

The above embodiments are merely for ease of understanding of the invention and are not for limited interpretation of the invention. It is needless to say that the invention can be changed or modified without departing from the spirit thereof and that the invention includes equivalents thereof.

The entire disclosure of Japanese Patent Application No. 2013-036781, filed Feb. 27, 2013 is expressly incorporated by reference herein.

What is claimed is:

1. A liquid discharge apparatus comprising:

a first roller support that supports a medium;

plurality of heads that each discharge liquid to the medium and towards different locations of the first roller support where the medium is transported on the first roller support, the plurality of heads being arranged along a length of the first roller support in a direction of an axial center of the first roller support; and a drying portion that dries the liquid that has landed on the medium, the drying portion including a hot-air blowing portion and a hot-air exhaustion portion, each of which extends below the first roller support in a horizontal direction;

wherein the liquid discharge apparatus has a heated area caused by the hot-air blowing portion and a non-heated area caused by the hot-air exhaustion portion, in which the drying portion is disposed in the heated area, and the first roller support and the head are disposed in the non-heated area, and wherein the medium traverses a path along the first roller support from a first end towards a second end, the medium alternating between being wound around a portion of the outer circumferential surface of the roller opposite one of the plurality of heads and passing through portions of the drying portion.

2. The liquid discharge apparatus according to claim 1, wherein the head is disposed at a position facing the outer circumferential surface of the first roller support;

the liquid discharge apparatus includes at least one second roller that winds the medium, to which the liquid is discharged, therearound upstream of the drying portion in a transporting path of the medium, and at least one third roller that winds the medium, to which the liquid is discharged, therearound downstream of the drying portion in the transporting path of the medium; and at least the third roller is disposed in the heated area.

3. The liquid discharge apparatus according to claim 2, further comprising:

a thermal insulator at least between the third roller and the first roller support.

4. The liquid discharge apparatus according to claim 2, further comprising at least one cooling portion that cools the medium transported at least between the third roller and the first roller support.

5. The liquid discharge apparatus according to claim 4, further comprising a plurality of second rollers, third rollers, heads, and cooling portions, respectively; and a plurality of kinds of liquid are discharged to the medium.

6. The liquid discharge apparatus according to claim 5, wherein the axes of the plurality of second rollers and the plurality of third rollers are angularly offset with respect to the axis of the first roller support, so that the medium is wound a plurality of times in the axial direction of the first roller support.

7. The liquid discharge apparatus according to claim 1, further comprising, a feed roll that feeds the medium to the first roller support; and a take-up roll that recovers the medium after the liquid is discharged, wherein the medium is fed out of the feed roll around which the medium before the liquid is discharged is wound and is taken up by the take-up roll after the liquid is discharged.

* * * * *